United States Patent [19]

Nelson et al.

[11] Patent Number: 4,684,072

[45] Date of Patent: Aug. 4, 1987

[54] BLADE FOR CENTRIFUGAL MEDIA MILL

[75] Inventors: Roy A. Nelson, South Haven, Mich.; Raymond A. Entriken, E. Liverpool, Ohio; Randolph C. Grieves, Allen Park, Mich.

[73] Assignee: Epworth Manufacturing Co., Inc., South Haven, Mich.

[21] Appl. No.: 864,674

[22] Filed: May 19, 1986

[51] Int. Cl.[4] ..... B02C 17/04

[52] U.S. Cl. ..... 241/172; 241/46.11; 241/46.17; 241/171

[58] Field of Search ..... 241/46.11, 46.17, 65, 241/66, 171, 172, 176, 275

[56] References Cited

U.S. PATENT DOCUMENTS

| | | | |
|---|---|---|---|
| 2,798,674 | 7/1957 | Denning | 241/275 X |
| 4,244,531 | 1/1981 | Szeguari | 241/172 |
| 4,582,266 | 4/1986 | Entrikin et al. | 241/172 |

*Primary Examiner*—Timothy V. Eley

*Attorney, Agent, or Firm*—Flynn, Thiel, Boutell & Tanis

[57] ABSTRACT

A mill for effecting a reduction in size of a particulate in a particulate-containing substance wherein the mill includes a support structure, an elongated vessel rotatably mounted on the support structure about an axis of rotation as well as a drive motor therefor. The mill further includes an inlet port and an outlet port for allowing the particulate-containing substance to flow through the vessel structure. An elongate and generally cylindrical, hollow rotor body is provided and extends centrally of the vessel structure and along a majority of the length thereof. The rotor body is fixedly secured to the vessel structure and rotatable therewith. A plurality of cavities are disposed in and equally spaced about the cylindrical peripheral surface on the hollow rotor body so that each cavity opposes the inner surface of the vessel structure. Plural deflectors are equally spaced from each other and are fixedly oriented in the space between the rotor body and the inner surface of the vessel structure for deflecting a comminuting media in the vessel radially inwardly into the cavities only to be again flung radially outwardly, in response to a rotation of the vessel structure and the rotor body, into engagement with the fixed deflectors. All of the aforesaid cavities in the rotor body have a total volume approximately equal to the total volume of the plural deflectors. Further, all of the aforesaid cavities have at least a portion of an internal wall surface which is approximately an inverted image of an external radially inwardly facing side on each of the deflectors.

7 Claims, 4 Drawing Figures

BLADE FOR CENTRIFUGAL MEDIA MILL

FIELD OF THE INVENTION

This invention relates to a rotor construction for use in comminuting a particulate-containing substance to effect a reduction in the size of the particulate therein.

BACKGROUND OF THE INVENTION

Many devices are known for effecting a reduction in the size of a particulate in a particulate-containing substance. One such device is disclosed in U.S. Pat. No. 4,582,266. A listing of such further prior art devices is set forth in "Description of the Prior Art" appearing in U.S. Pat. No. 4,244,531. As the prior art will reveal, various structures have been employed over the years to effect an agitation of the comminuting media to effect the desired result. Each of these various structures provides varying degrees of shear forces and impact forces for effecting the desired reduction in size of the particulate.

It is frequently desirable to cause particle size reduction of a solid contained in a liquid. Liquids are frequently wanted and desirable in the total product system. For example, liquids tend to replace undesirable gasses held by the particle. Further, more uniform particle size distribution is obtainable with liquid additions and a desired reaction or bond may even be created. However, in continuous type mills, that is, mills wherein a product is continually introduced into the comminuting vessel at one end and the comminuted mixture is removed at the opposite end, a strong desire has existed for many years in providing apparatus which would quickly process the product flowing therethrough so as to increase the productivity of the mill. However, the length of time that the product remains in the mill is directly related to the particle size of the particulate desired in the output mixture. Further, considerable energy is consumed during the period of time that the mill is in operation. Thus, the cost of energy per unit of product can be greatly diminished if the amount of product being processed through the mill can be substantially increased. It has been discovered that the construction of the rotor has a direct influence on the efficiency of the mill.

Accordingly, it is an object of this invention to provide a mill for continuously processing product or batch processing product wherein the comminuting media is sufficiently agitated and with a minimum of friction occurring between the moving parts to achieve the desired amount of comminution of a particulate-containing product.

It is a further object of this invention to provide a continuous type mill, namely, a mill wherein product is introduced at one end of the vessel and the comminuted mixture removed at the opposite end, wherein the comminuting media is sufficiently agitated and with a minimum of friction occurring between the moving parts to achieve the desired amount of comminution of a particulate-containing product.

It is a further object of the invention to provide a mill, as aforesaid, wherein the speed of rotation of the vessel and related rotor is selected based on the size of the media, the density of the media and the viscosity and density of the product to be processed, so that the centrifical force generated during a rotation of the vessel and related rotor will cause the media to generate a force equal to many times the weight of the media and further provide an interruption of the movement of the comminuting media to effect a deceleration of the comminuting media only to have it reaccelerated again to generate the desired comminuting action in the media.

It is a further object of this invention to provide a mill, as aforesaid, wherein an increase in the output of the comminuted mixture is effected thereby reducing the energy consumed in comminuting the product per unit of product produced.

It is a further object of the invention to provide a one-piece rotor having plural cavities therein, each shaped in an inventive manner relative to a deflector blade to enhance the efficiency of operation of the mill. It is further object of this invention to provide a mill, as aforesaid, which is durably constructed and which will provide a generally maintenance-free operating characteristic.

SUMMARY OF THE INVENTION

In general, the objects and purposes of the invention are met by providing a mill for effecting a reduction in size of a particulate in a particulate-containing substance wherein the mill includes a support structure, an elongated vessel rotatably mounted on the support structure about an axis of rotation as well as a drive motor therefor. The mill further includes an inlet port and an outlet port for allowing the particulate-containing substance to flow through the vessel structure. An elongate and generally cylindrical, hollow rotor body is provided and extends centrally of the vessel structure and along a majority of the length thereof. The rotor body is fixedly secured to the vessel structure and rotatable therewith. The rotor body has a diameter substantially less than the inner surface of the vessel structure to define a space therebetween. A plurality of cavities are disposed in and equally spaced about the cylindrical peripheral surface on the hollow rotor body so that each cavity opposes the inner surface of the vessel structure. A comminuting media is provided in the space as well as in the cavities. A drive motor effects a driving of the vessel structure and the rotor body for rotation at a preset speed to fling the comminuting media radially outwardly. Plural deflectors are equally spaced from each other and are fixedly oriented in the space between the rotor body and the inner surface of the vessel structure for deflecting the comminuting media radially inwardly into the cavities only to be again flung radially outwardly, in response to a rotation of the vessel structure and the rotor body, into engagement with the fixed deflectors. All of the aforesaid cavities in the rotor body have a total volume approximately equal to the total volume of the plural deflectors. Further, all of the aforesaid cavities have at least a portion of an internal wall surface which is approximately an inverted image of an external radially inwardly facing side on each of the deflectors. An external radially outwardly facing surface on each of the deflectors extends approximately parallel to the aforesaid inner surface of the vessel structure.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
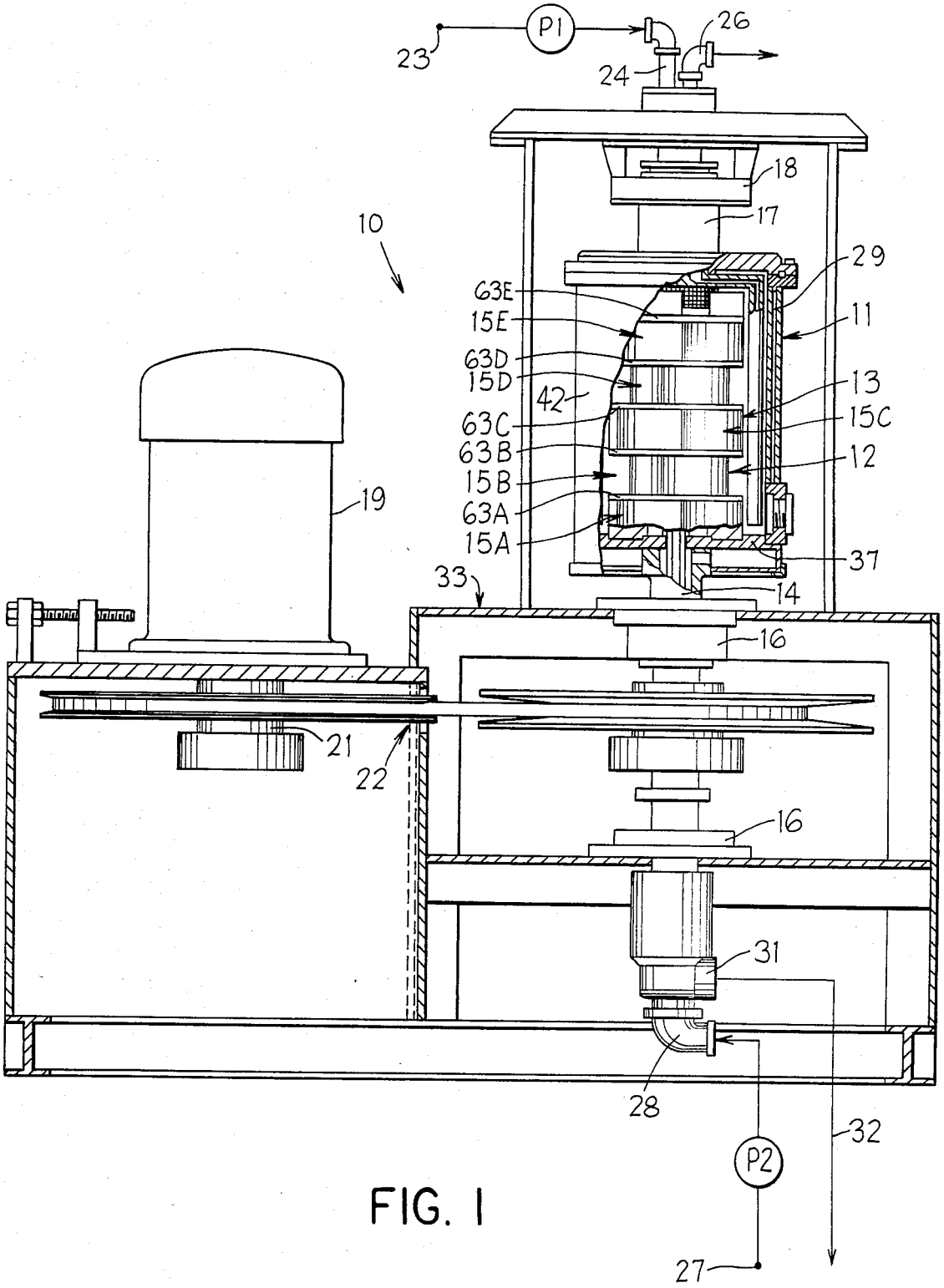
FIG. 1 is a partially sectioned side elevational view of a continuous type mill embodying the invention.

Certain terminology may be used in the following description for convenience in reference only and will not be limiting. The words "up," "down," "right" and "left" will designate directions in the drawings to which reference is made. The words "in" and "out" will refer to directions toward and away from, respectively, the geometric center of the device and designated parts thereof. Such terminology will include the words above specifically mentioned, derivatives thereof and words of similar import.

In accordance with the preferred embodiment shown in the drawings, an agitated media comminuting mill 10 includes a comminuting vessel 11, a portion of which is broken away to show the internal structure of the mill and hereinafter described. Although the comminuting vessel 11 is substantially a right circular cylinder, vessels having other geometry, such as an inverted cone, can also be used for certain applications. The vessel 11 also includes an inventive centrally disposed unitary rotor 12 therein which, in this particular embodiment, is fixedly secured to the vessel 11. The rotor 12 has a hollow rotor body 13 and a plurality of cavities 15 integrally formed in the outside surface thereof. The vessel 11 is rotatably supported on an upstanding shaft 14, which shaft is rotatably supported in a pair of axially spaced bearing structures 16 located at the lower end of the vessel 11. The vessel 11 also has an upstanding neck portion 17 at the upper end thereof which is rotatably received in a bearing construction 18. The shaft 14 is rotatably driven by an electric motor 19, the output shaft 21 of which is connected to the shaft 14 through a preferably variable speed transmission device 22.

A particulate-containing flowable substance is introduced from a reservoir 23 into the vessel through an inlet connection 24 by means of a variable speed pump P1. Comminuted product is removed from the vessel through an outlet connection 26. In addition, and in order to maintain the vessel at a desired operating temperature, a heat exchanging fluid is introduced from a reservoir 27 to an inlet connection 28 by means of a variable speed pump P2. The heat exchange fluid can also be supplied from a pressurized source controlled by a valve so that the pump P2 could be eliminated. The inlet connection 28 is connected in fluid circuit with a passageway system 29 surrounding the vessel 11. The heat exchanging fluid is removed from the passageway system 29 through an outlet connection 31 and an appropriate connecting line 32 schematically illustrated. The vessel 11 and the electric motor 19 are mounted on an appropriate support structure 33 which will not be described in any detail.

The foregoing discussion describes only in general terms the various structural components of the continuous type mill 10. The following description will describe in more detail the various components of the mill.

Figure 2:
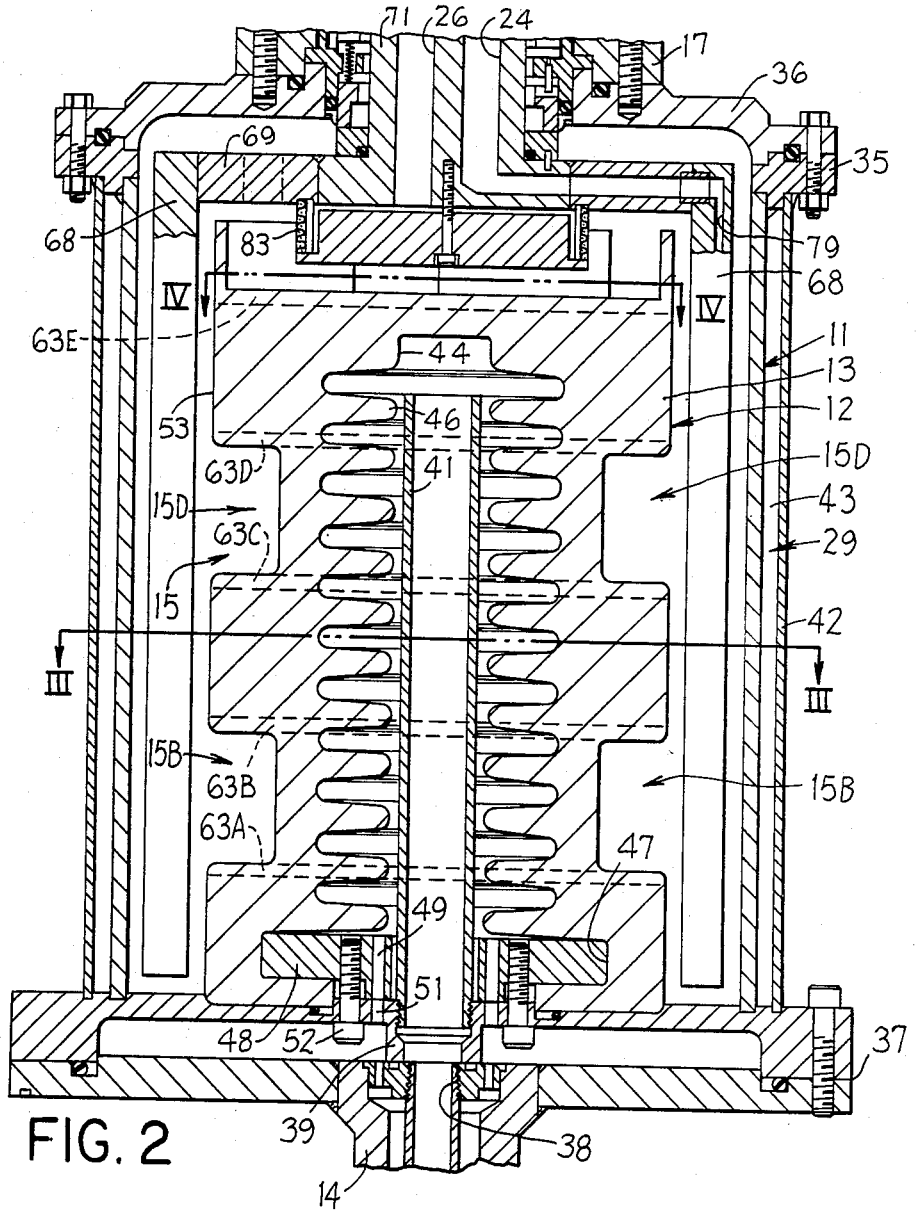
FIG. 2 is an enlarged sectional view of the vessel and the inventive rotor therein taken along the line II—II of FIG. 4.

Referring to FIG. 2, the vessel 11 has the rotor 12 disposed therein. As stated above, the vessel 11, in the preferred embodiment, is a right circular cylinder having an annular ring 35 and cover 36 fixedly secured to one end thereof and a plate 37 closing off the other end thereof. While the vessel is disclosed in this particular environment in an upright position, it is to be noted that this arrangement can also be utilized with a vessel lying on its side. Therefore, and while the following discussion will describe the vessel in its upright illustrated position, such discussion concerning the orientation thereof is not to be limiting. Thus, and in this particular embodiment, the annular ring 35 is located at the top of the vessel and the plate 37 closes off the bottom of the vessel. A centrally disposed hole 38 extends through a fluid coupling member 39 in the plate 37. The shaft 14 is a hollow shaft and is fixedly secured to the underside of the plate 37 and in axial alignment with the hole 38 and coupling member 39. A pipe 41 is coupled to the coupling member 39 by any convenient means. The pipe 41 extends inside the hollow rotor body 13.

A right circular cylindrical shell 42 is fixedly connected at one end to the annular ring 35 and extends in a telescoped manner over the outside of the vessel 11 and terminates at the plate 37. The diameter of the shell 42 is greater than the diameter of the vessel so that a spacing 43 is provided therebetween and which forms a part of the passageway system 29. This space allows for the flow of a coolant therethrough. Further details concerning the coolant passageways can be found in U.S. Pat. No. 4,582,266.

The hollow rotor body 13 has a central recess 44 therein, which recess 44 has plural fins 46 projecting radially inwardly from the inner wall to provide a greater surface area to facilitate cooling of the rotor body 13 as a coolant flows therepast. The innermost diameter of the fins 46 is slightly greater than the outermost diameter of the pipe 41. Thus, as coolant flows into the interior of the hollow body 13 through the pipe 41, the coolant will flow between the external surface of the pipe 41 and across the fins 46 to maintain the rotor body 13 at a desired operating temperature. A pair of diametrically spaced recesses 47 is provided adjacent the bottom of the interior portion of the rotor body 13 and is adapted to receive therein the opposite ends of an elongated bar 48 having plural holes 49 therein aligned with holes 51 in the bottom plate 37 to allow for the coolant to exit from the interior of the rotor body 13. The bar 48 is secured to the bottom plate 37 by plural screws 52 to effect a fixed securement of the rotor body 13 to the vessel 11.

Figure 3:
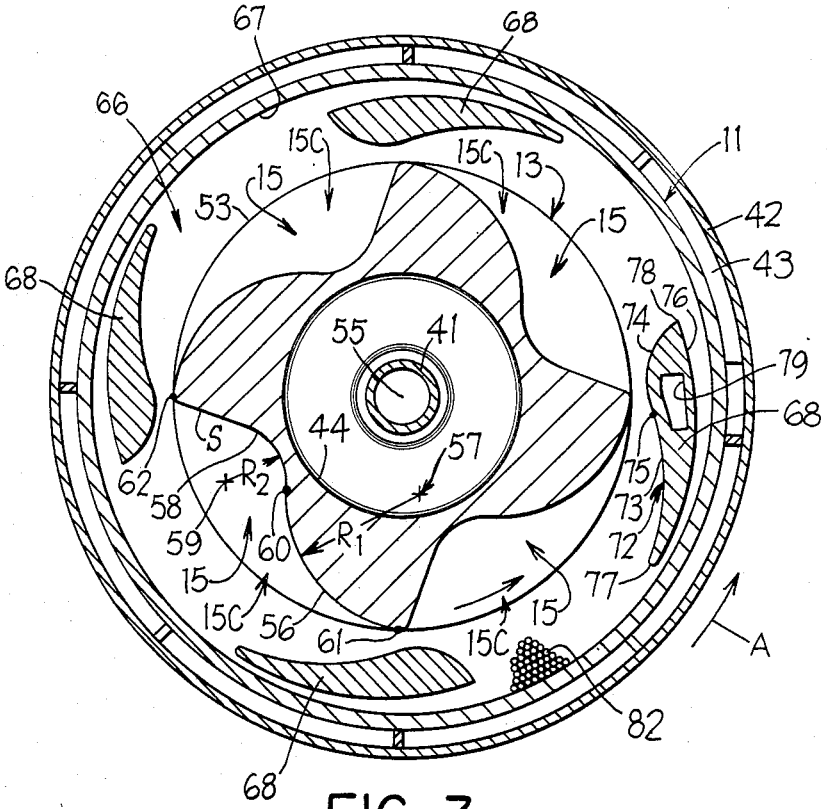
FIG. 3 is a sectional view taken along the line III—III of FIG. 2.

The exterior surface 53 of the rotor body 13 is cylindrical. The plurality of cavities 15 are provided in the exterior surface 53 of the rotor body 13 as shown in FIG. 3. Each cavity 15 is comprised of several surface segments. An entry surface segment 56 includes a convex, cylindrically curved surface having a radius $R_1$, the center of which is located internally of the rotor body, preferably at a location 57 inside the recess 44. The axis for the center 57 extends parallel to the central axis 55 of the rotor body 13. The interior wall surface of the cavity 15 also includes a concave, cylindrically curved acceleration surface segment 58 having a radius $R_2$, the center 59 of which is located in the cavity 15 as shown in FIG. 3. The axis for the center 59 extends parallel to the central axis 55 of the rotor body 13. An exit surface segment S extends on a tangent to the acceleration surface segment 58 and terminates at the peripheral surface 53 of the rotor body 13. The starting point of the entry curve 56 is at the peripheral surface 53 at a point 61. The point at which the exit surface segment S intersects the peripheral surface 53, namely, at point 62 is spaced 90° from the point 61 as illustrated in FIG. 3. The entry segment and the acceleration segment intersect at a point of inflection 60. All surfaces in each cavity extend parallel to the central axis 55 of the rotor body 13.

In the embodiment illustrated in FIG. 2, the plural cavities 15 are oriented in five vertically spaced planes perpendicular to the axis of rotation of the vessel 11. Further, the cavities in mutually adjacent planes are angularly offset by 45° in their locations with respect to each other. In other words, and referring to FIG. 4, the cavities 15E are each angularly offset to the cavities 15D and so on along the length of the rotor body 13. The locations 63A, 63B, 63C, 63D, 63E on the rotor body 13 whereat no cavities are provided around the entire circumference is generally cylindrical, as stated above, and forms a dividing barrier between the cavities 15 in one plane and the cavities 15 in the other plane. Further, the uppermost location 63E provides a barrier between the uppermost set of cavities 15E and the top of the rotor body. In other words, the locations 63A to 63E each define a disk-like segment which separates the vertically spaced cavities 15A to 15E from each other and other structure as stated above. Further, the axial extent of each disk-like segment is substantially less than the axial extent of each cavity.

A space 66 is provided between the external surface 53 of the rotor body 13 and the internal surface 67 of the vessel 11. A plurality of deflectors 68 are equidistantly spaced from one another and are nonmovably oriented in the space 66. In this particular embodiment, each deflector 68 is secured to the outer peripheral edge of an annular disk 69 extending radially outwardly from a fixed shaft member 71 comparable to the fixed shaft shown and described in U.S. Pat. No. 4,582,266 and located at the top portion of the interior of the vessel 11. The deflectors 68 extend downwardly from the disk 69 almost the entire height of the interior of the vessel and at least coextensively with the rotor body 13. The shaft 71 also provides a support for the rotary movement of the vessel 11.

The deflectors each have an airfoil-like cross section. The radially inwardly facing surface 72 has a contour that is generally an inverted image of the radially outwardly facing contour of each of the cavities 15. That is, the arcuate, radially inwardly facing convex surface segment 73 has a surface contour that is similar in shape to the concave entry segment 56 in each of the cavities 15. The concave arcuate segment 74 is curved closely similarly to the convex acceleration section 58. The arcuate surfaces 73 and 74 intersect at a point of inflection 75. The radially outwardly facing surface 76 of each deflector 68 has a continuous arcuate contour that extends approximately parallel to the internal surface 67 of the vessel 11 and the external surface 53 of the rotor body 13. In this particular embodiment, however, the deflector 68 is oriented so that the radially outwardly facing surface 76 does not extend parallel to the internal surface 67 but is, instead, angled thereto so that the leading edge 77 of each deflector 68 is spaced closer to the internal surface 67 than the trailing edge 78. All of the exterior surfaces on the deflectors extend parallel to the central axis 55 of the rotor body 13.

In this particular embodiment, only one deflector 68 has an internal passageway 79 extending therethrough, which passageway communicates with the inlet passageway 24 as illustrated in FIG. 2.

In addition to the specific shape of each cavity 15 and the specific shape of each deflector 68, another very important feature is that each cavity 15 has a specified volume and that the sum total of the volume on the rotor body 13 is approximately to equal the total volume of space within the space 66 occupied by each deflector 68. Stated differently, if each of the deflectors 68 were converted to a liquid, the total volume of the liquid would fill approximately each of the cavities 15 so that the surface contour of the rotor body 13 would not have any cavities therein. The total volume of the cavities and total volume of the liquid might vary by a few cubic centimeters.

OPERATION

Upon an energization of the electric motor 19, the output shaft 21 thereof will drive through the variable speed transmission device 22, the shaft 14 to effect a rotation of the shaft 14, the vessel 11 and the rotor 12. Comminuting media, only schematically illustrated at 82 in FIG. 3, is present in the vessel 11 and agitation thereof is started upon the attainment of a specified speed of rotation for the vessel 11. As the vessel attains a desired critical speed, namely, that speed which causes the media to move as a mass with the vessel and causes the media to be flung radially outwardly, the media will move as a mass into an upright cylindrical column packed against the internal surface 67 of the vessel 11 and in the direction of the arrow A in FIG. 3. The critical speed is defined by the formula in the aforementioned U.S. Pat. No. 4,582,266 and reference thereto is to be incorporated herein.

Figure 4:
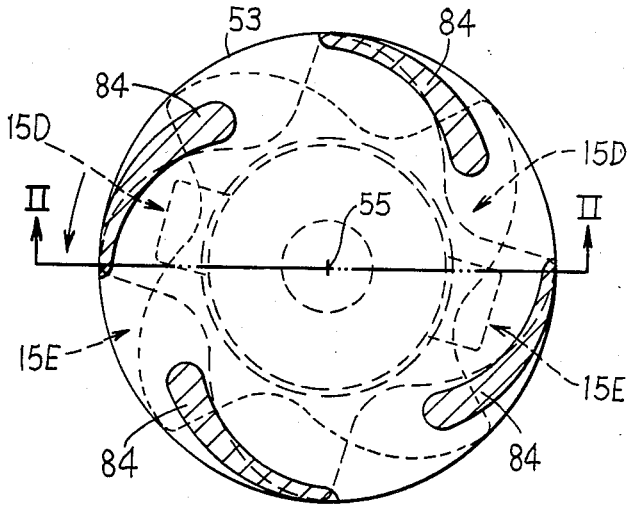
FIG. 4 is a sectional view taken along the line IV—IV of FIG. 2.

The effective weight of the media varies as the square of the rotational speed. This phenomena allows a small sized media to create a force equal to a force equal to a larger media when subjected to high centrifical force. All of this phenomena is set forth in the aforesaid U.S. Pat. No. 4,582,266. What is not present in the aforementioned patent is the structure of the cavities 15 and the operative cooperation therewith by the specifically shaped deflectors 68 and the fact that the total volume of the cavities is to equal the total volume of space occupied within the space 66 by the total number of deflectors 68. It has been discovered that this structural feature will effect an optimized movement of the media radially inwardly into the cavities as well as radially outwardly from the cavities to optimize a processing of the particulate-containing substance introduced into the vessel 11 through the inlet passageway 24 and passageway 79 through the deflector 68. The processed substance is removed from the vessel through a screen or mesh 83 and out through an outlet passageway 26. To prevent a packing of the media around the mesh 83 causing excessive wear thereto, plural blades 84 have been provided on the top surface of the rotor body 13 as illustrated in FIG. 4. These vanes effect a movement of the media. In this particular embodiment, the vanes 84 maintain continued movement of the media thereby preventing blockage of the mesh and a preventing of an exiting of the processed particulate-containing substance.

The media 82 moves in the pattern disclosed fully in the aforementioned U.S. Pat. No. 4,582,266. Further discussion concerning the specific movement of the media is believed, therefore, unnecessary.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mill for effecting in a particulate-containing substance a reduction in size of said particulate, comprising:

support means;

an elongated vessel means rotatably mounted on said support means about an axis of rotation, and drive means therefor, said vessel means having a generally cylindrical interior;

inlet and outlet means in said vessel means for said particulate-containing substance;

an elongate and generally cylindrical, hollow rotor body extending centrally of said cylindrical interior of said vessel means and along a majority of the length thereof and being fixedly secured to said vessel means, said generally cylindrical rotor body having a diameter substantially less than an inner cylindrical surface of said vessel means to define a space therebetween;

means defining a plurality of cavities disposed in and equally spaced about on a cylindrical peripheral surface of said hollow rotor body so that said cavities each oppose said inner surface of said vessel means;

comminuting media in said space in said vessel means and said cavities;

drive means for driving said vessel means and said rotor body for rotation at a preset speed to fling said comminuting media radially outwardly;

plural deflector means equally spaced from each other and fixedly oriented in said space for deflecting said comminuting media radially inwardly into said cavities whereby said comminuting media is accelerated and again flung radially outwardly, in response to a rotation of said vessel means and said rotor body, into engagement with said fixed deflector means, the sum total of the volumes of all of said cavities in said rotor body having a total volume approximately equal to the total volume of said plural deflector means within said space, all of said cavities further having at least a portion of an internal wall surface which is approximately an inverted image of an external, radially inwardly facing side of each said deflector means, an external radially outwardly facing surface of each said deflector means extending approximately parallel to said inner surface of said vessel means.

2. A mill according to claim 1, wherein said plural cavities in said rotor body are oriented in at least one plane perpendicular to an axis of rotation of said vessel means and said rotor body.

3. A mill according to claim 2, wherein said plural cavities are oriented in plural parallel planes.

4. A mill according to claim 1, wherein at least one of said deflector means includes a passageway extending longitudinally thereof and therethrough and forms a part of said inlet means for said substance.

5. A mill according to claim 1, wherein said internal wall surface of each cavity extends parallel to an axis of rotation of said vessel means and said rotor body and is comprised of at least three sections, namely an entry section having a convex surface contour, a starting position for which is from said peripheral surface of said rotor body and curving radially inwardly about a first axis, an acceleration section having a concave surface contour, said entry and acceleration sections merging at approximately a point of inflection and an exit section that extends at tangent to said acceleration section until an ending position at said peripheral surface of said rotor body.

6. A mill according to claim 5, wherein said plural cavities in said rotor body are oriented in at least one plane perpendicular to an axis of rotation of said vessel means and said rotor body; and wherein said plane includes four of said cavities, said starting and said ending positions being oriented 90° apart on said rotor body.

7. A mill according to claim 6, wherein at least a pair of planar walls extend in parallel planes which are perpendicular to said axis of rotation and form sidewalls of each said cavity in said at least one plane.

* * * * *